US010551146B2

(12) United States Patent
Lamb

(10) Patent No.: US 10,551,146 B2
(45) Date of Patent: Feb. 4, 2020

(54) BRACKET FOR MOUNTING A WEAPON AND HOLSTER

(71) Applicant: Tyson G. Lamb, Ames, IA (US)

(72) Inventor: Tyson G. Lamb, Ames, IA (US)

(73) Assignee: Tyson G Lamb, Ames, IA (US)

( * ) Notice: Subject to any disclaimer, the term of this patent is extended or adjusted under 35 U.S.C. 154(b) by 0 days.

(21) Appl. No.: 16/026,562

(22) Filed: Jul. 3, 2018

(65) Prior Publication Data

US 2019/0011220 A1 Jan. 10, 2019

Related U.S. Application Data

(60) Provisional application No. 62/528,179, filed on Jul. 3, 2017.

(51) Int. Cl.
*F41C 33/00* (2006.01)
*F41C 33/04* (2006.01)

(52) U.S. Cl.
CPC ..... *F41C 33/041* (2013.01)

(58) Field of Classification Search
CPC ..... F41C 33/041
USPC ..... 224/243
See application file for complete search history.

(56) References Cited

U.S. PATENT DOCUMENTS 2,668,645 A * 2/1954 Pease ..... B60R 7/14 224/546
4,364,499 A * 12/1982 McCue ..... B60R 7/14 211/64
4,466,148 A * 8/1984 Jones ..... A47C 21/00 108/55.1
5,076,531 A * 12/1991 Delaney ..... B60R 11/06 211/4
5,129,563 A * 7/1992 Dillon ..... B60R 7/14 224/275
5,438,787 A * 8/1995 McMaster ..... A47B 81/005 211/64
5,979,846 A * 11/1999 Fluhr ..... B60R 7/14 211/64
6,584,719 B1 * 7/2003 Morford ..... B60R 7/14 224/551
2008/0230663 A1 * 9/2008 Svehlek ..... E06C 7/48 248/211
2017/0160050 A1 * 6/2017 Alfaro ..... G08B 13/14
2018/0010883 A1 * 1/2018 Tedder ..... B60R 7/14
2018/0142989 A1 * 5/2018 Tedder ..... F41C 33/041
2019/0016269 A1 * 1/2019 Beach ..... B60R 7/14

* cited by examiner

*Primary Examiner* — Peter N Helvey
(74) *Attorney, Agent, or Firm* — Zarley Law Firm, PLC

(57) ABSTRACT

A bracket for mounting a weapon and a holster has a first bracket member having a back wall and a pair of side walls. Adjacent an outer edge of the side walls are cut-out grooves that slidably receive a block. The block has bores on side edges that are positioned to selectively align with mounting holes in the side walls of the first bracket member.

13 Claims, 4 Drawing Sheets

BRACKET FOR MOUNTING A WEAPON AND HOLSTER

CROSS REFERENCE TO RELATED APPLICATION

This application claims the benefit of U.S. Provisional Application No. 62/528,179 filed Jul. 3, 2017.

BACKGROUND OF THE INVENTION

This invention is directed to a mounting bracket for a weapon secured in a holster.

Presently, many small gun owners use a holster that clips to their belt for carrying small hand guns. When not in use, and particularly when one is in a location that they are prohibited from carrying such as a post office, the holster and hand gun are removed and laid aside. Alternatively, the holster is left on and only the hand gun is set aside.

This process creates safety issues. For example, the hand gun may be bumped and accidently discharged. Alternatively, a young child may access the hand gun and accidently discharge the weapon. Therefore, there is a need in the art for a device that addresses these deficiencies.

An objective of the present invention is to provide a bracket for mounting a weapon and a holster to a fixed object.

Another objective of the present invention is to provide a bracket that permits one to safely store a weapon and holster when not in use and/or carried.

These and other objectives will be apparent to those skilled in the art based upon the following written description, drawings, and claims.

SUMMARY OF THE INVENTION

A bracket for mounting a weapon and holster includes a first mounting member having a back wall and a pair of side walls that extend perpendicularly away from the back wall to form a C-shape. The back wall has a plurality of mounting holes that permit the bracket to be mounted to a fixed secure surface such as on a wall, table, or the like.

The side walls have a pair of elongated grooves adjacent a side edge that extend from a first end to a second end. The cut-out grooves have a plurality of mounting holes. Slidably received within the cut-out grooves is a block. The block has side edges having bores that selectively align with the mounting holes in the cut-out grooves. Preferably, a leading edge of the block is chamfered.

DETAILED DESCRIPTION OF THE PREFERRED EMBODIMENTS

Figure 1:
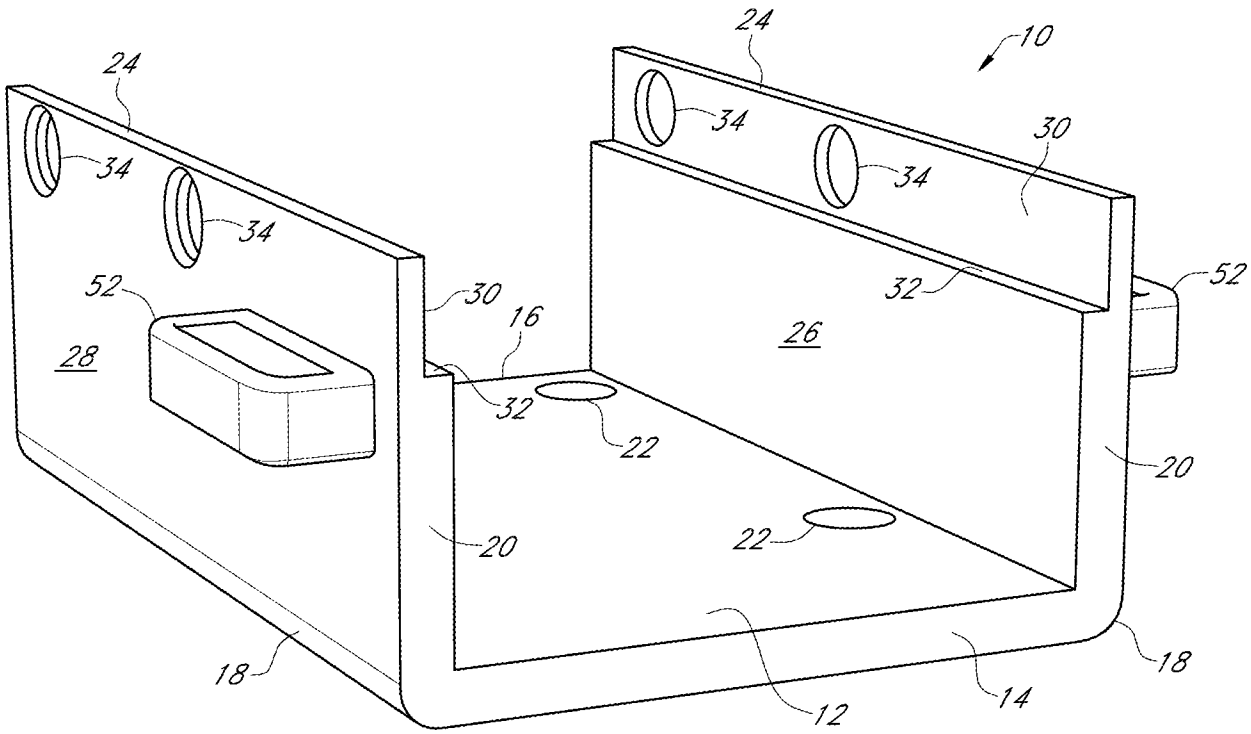
FIG. 1 is a perspective view of a first bracket member.
Figure 2:
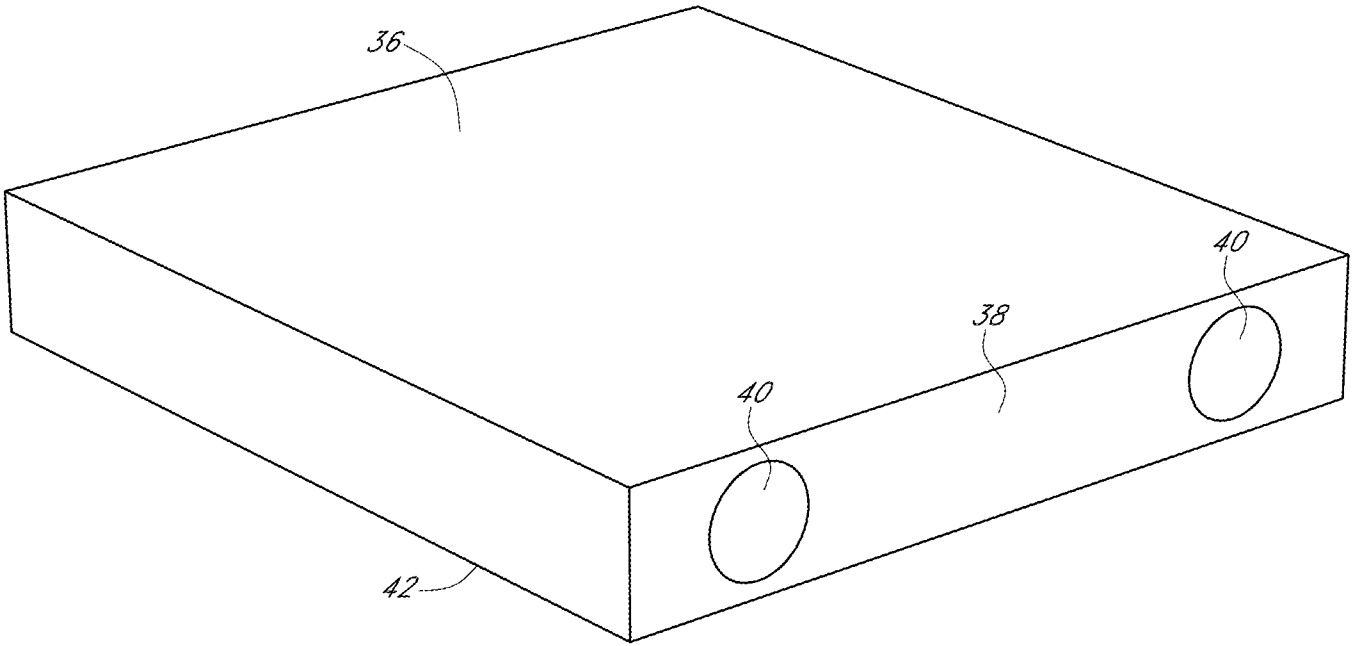
FIG. 2 is a perspective view of a block.
Figure 3:
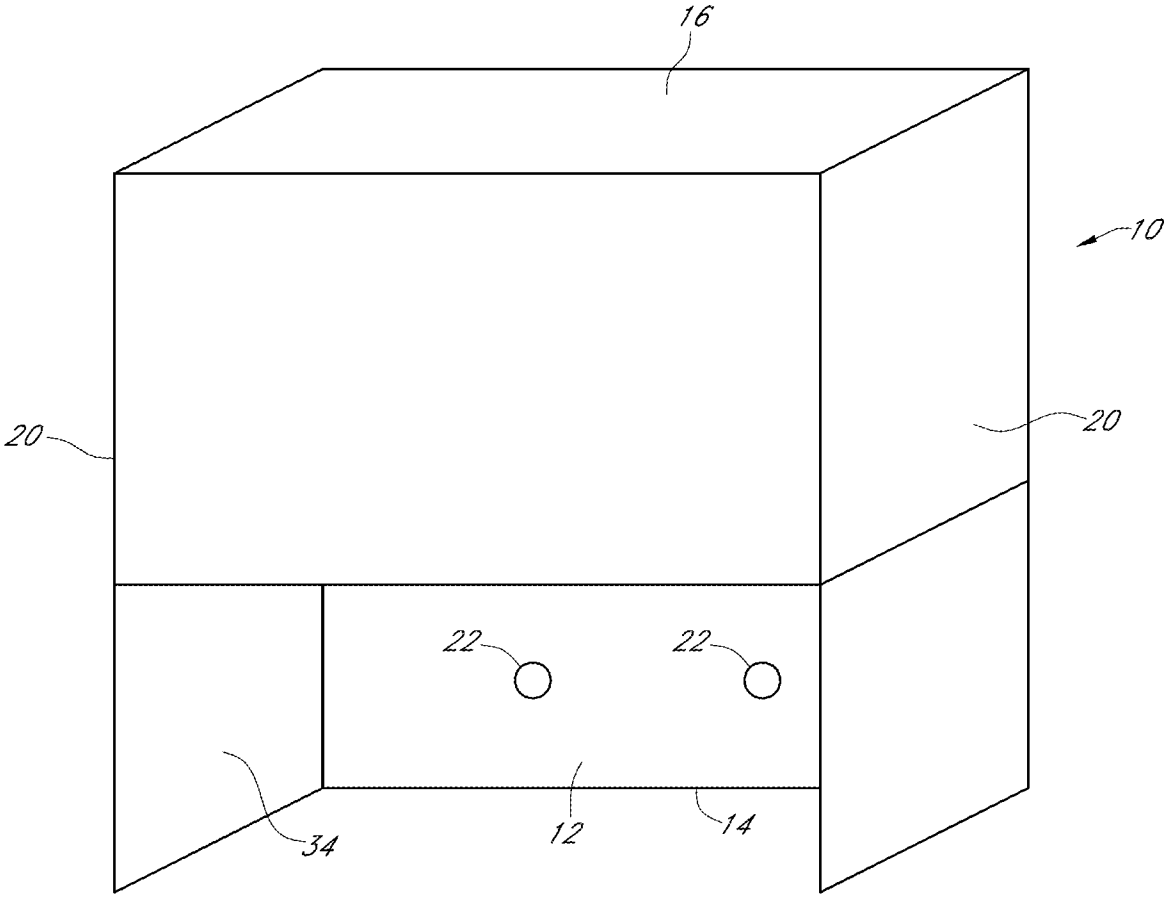
FIG. 3 is a perspective view of a bracket member.
Figure 4:
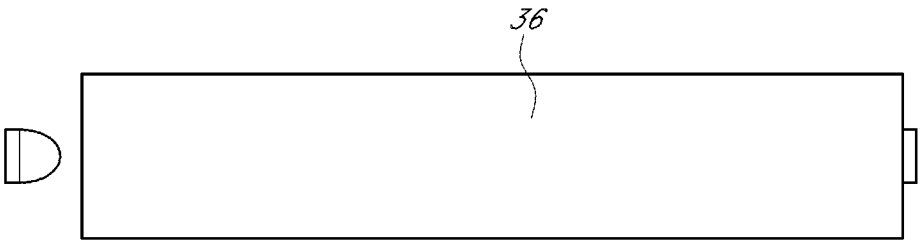
FIG. 4 is a side view of a block.

Referring to the Figures, a bracket 10 for mounting a holster and weapon has a first or back wall 12 with a first end 14, a second end 16, and a pair of side edges 18. Extending perpendicularly from the side edges of the back wall 12 are a pair of side walls 20.

The back wall 12 has a plurality of mounting holes 22 formed to receive a screw (not shown) for mounting the bracket 10 to a fixed object such as a wall, a desk, a console of a vehicle or the like.

The side walls 20 have an outer edge 24, an interior surface 26, and an exterior surface 28. A portion of the interior surface 26, adjacent the outer edge 24, is a cut-out groove 30 having a shoulder 32. Extending through the side walls 20 in the cut-out groove 30 portion, are a plurality of connecting holes 34.

A slidable block 36 is configured to extend between the side walls 20 and is slidably received within the cut-out grooves 30. The slidable block 36 has side edges 38 that have connecting bores 40 positioned to align with the connecting holes 34 of the side walls 20. Screws (not shown) are inserted through holes 34 and into bores 40 to hold the slidable block 36 in place. In a preferred example, a leading edge 42 of the slidable block 36 is chamfered. The thickness of the slidable block varies to accommodate different holster clips.

In operation, the bracket 10 is mounted to a fixed object using screws that extend through mounting holes 22. A slidable block 36, having a desired thickness, is slid into the cut-out groove 30 until the bores 40 align with holes 34. Screws are inserted through holes 34 and into bores 40 to hold the slidable block 36 in place.

Once mounted, when needed, a user removes a holster having a sleeve and a clip from their belt. The end of the clip engages the leading edge of the slidable block 36 which opens the clip so that the clip is secured to the slidable block 36. For added safety, a strap is threaded through loops 52 extending outwardly from the exterior surface 28 of the side walls 20 and around the holster to further prevent movement.

In an alternative embodiment, the first bracket member 10 has a stationary partial front wall.

Accordingly, a bracket for mounting a holster and a weapon has been disclosed that at the very least meets the stated objectives.

What is claimed is:

1. A bracket for mounting a weapon and a holster, comprising:

a bracket having a back wall and a pair of side walls that extend perpendicularly from a pair of side edges of the back wall, wherein an interior surface of the side walls, adjacent an outer edge opposite the back wall, have cut-out grooves having a shoulder; and a block slidably connected to the side walls of the bracket wherein the block is adapted to engage, open, and secure a clip of a holster.

2. The bracket of claim 1 wherein the back wall of the bracket has mounting holes.

3. The bracket of claim 1 wherein the cut-out grooves have mounting holes that selectively align with connecting bores on side edges of the block.

4. The bracket of claim 1 wherein the block is slidably received within cut-out grooves on the side walls of the bracket.

5. The bracket of claim 1 wherein the block has a leading edge that is chamfered.

6. The bracket of claim 1 wherein a loop extends outwardly from the exterior surface of each side wall.

7. A bracket for mounting a weapon and a holster, comprising:

a bracket having a back wall and a pair of side walls that extend from the back wall, wherein an interior surface of the side walls have cut-out grooves having a shoulder; and a block slidably received within the cut-out grooves and between the side walls of the bracket wherein the block is adapted to engage, open, and secure a clip of a holster.

8. A bracket for mounting a weapon and a holster, comprising:

a bracket having a back wall with a first end, a second end, and a pair of side edges;

the back wall having a plurality of mounting holes;

a pair of side walls extending perpendicularly from the side edges of the back wall;

the pair of side walls having an outer edge, an interior surface, and an exterior surface;

a portion of the interior surface of each side wall having a cut-out groove;

the cut-grooves having a shoulder and a plurality of connecting holes;

a slidable block having side edges with connecting bores;

wherein the connecting bores of the slidable block are configured to align with the connecting holes of the pair of side walls; and wherein the slidable block is configured to be slidably received within the cut-out grooves such that the slidable block extends between the pair of side walls.

9. The bracket of claim 8 further comprising a leading edge of the slidable block is chamfered.

10. The bracket of claim 8 wherein the slidable block is configured to receive a clip of a holster.

11. The bracket of claim 8 further comprising a loop extending outwardly from the exterior surface of each of the pair of side walls.

12. The bracket of claim 11 further comprising a strap threaded through the loops.

13. The bracket of claim 8 further comprising a stationary partial front wall.

* * * * *